United States Patent [19]

Mariani

[11] 4,241,717

[45] Dec. 30, 1980

[54] OSCILLATING FLIGHT CONTROL DEVICE FOR A BALL PROJECTING MACHINE

[76] Inventor: Maurice Mariani, 2285 rue St-Mathieu, app. 801, Montreal, Quebec, Canada, H3H 2S7

[21] Appl. No.: 911,038

[22] Filed: May 30, 1978

[51] Int. Cl.[2] ..... F41D 9/00

[52] U.S. Cl. ..... 124/83; 74/47

[58] Field of Search ..... 124/56, 68, 64, 63, 124/83, 84, 80; 302/61, 63; 193/16, 21, 22; 239/225, 588; 273/30, 26 D; 74/47, 51

[56] References Cited

U.S. PATENT DOCUMENTS

| | | | |
|---|---|---|---|
| 1,687,178 | 10/1928 | Peterson | 239/225 X |
| 2,668,526 | 2/1954 | Woolsey | 124/9 |
| 3,879,866 | 4/1975 | Gunderson | 193/22 X |
| 3,905,349 | 9/1975 | Nielsen et al. | 124/56 X |
| 4,027,646 | 6/1977 | Sweeton | 124/56 |

*Primary Examiner*—William R. Browne
*Attorney, Agent, or Firm*—Raymond A. Robic

[57] ABSTRACT

A device for use with a tennis ball projecting machine to control the flight of the balls projected from the machine through a flexible tube. The device has a pair of adjacent casings supporting the tube. The first casing is pivotably mounted at its rear end to the machine for swinging about a vertical axis. The second casing is pivoted at its rear end to the front end of the first casing and holds the outlet end of the tube at its free end. The second casing can be moved up or down, and fixed in place, to control the ball trajectory. A power mechanism is provided on the device to oscillate the first casing, and thus the second as well, about the vertical axis to swing the ball projecting tube according to a predetermined angle about a vertical axis.

9 Claims, 4 Drawing Figures

FIG. 1
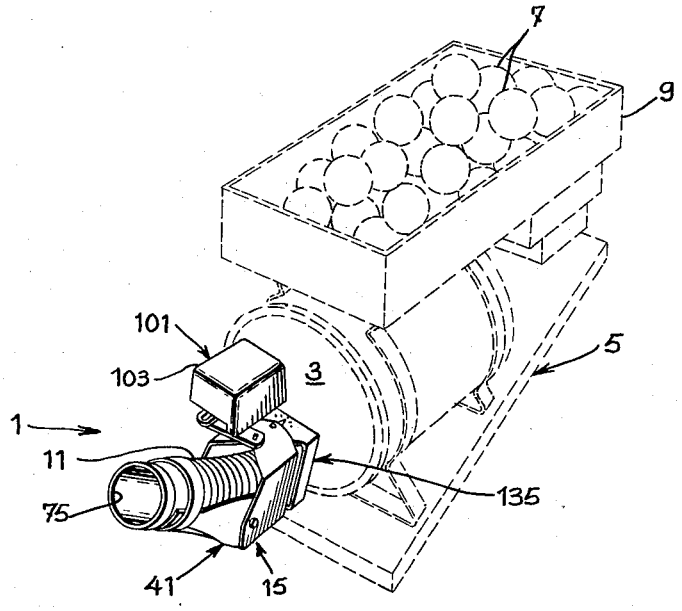
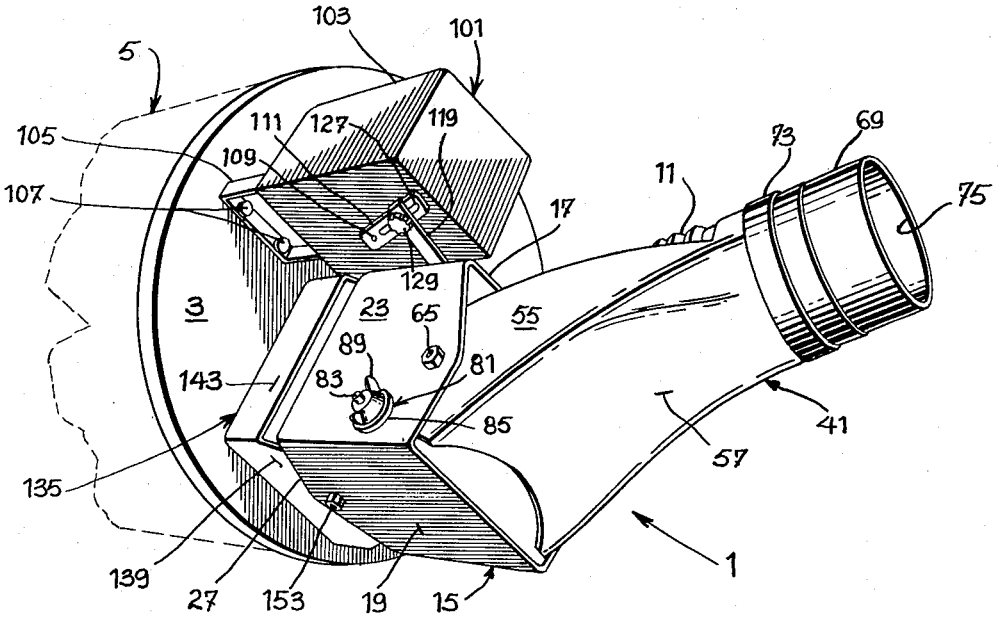
FIG. 2

OSCILLATING FLIGHT CONTROL DEVICE FOR A BALL PROJECTING MACHINE

This invention is directed toward a device for use with a ball projecting machine.

The invention is more particularly directed toward a ball flight control device for use with a tennis ball projecting machine.

Ball projecting machines are well known. These machines are used to simulate ball playing conditions to provide players with practice. Some machines, such as shown in U.S. Pat. No. 3,734,075 by way of example, project balls from between a pair of rotating wheels. Others, most commonly used in projecting tennis balls, employ air pressure to projects the balls. Many of these ball projecting machines however have no means for varying the trajectory and particularly the direction of ball projection. Such means are desirable, particularly in tennis ball projecting machines, so that the machine can project balls simulating flat drives or lobs, and can project balls to all areas of a tennis court. Known machines that do have means for varying the trajectory, and particularly the direction, of the projected ball, are expensive and cumbersome. The known machines vary ball direction by oscillating the entire ball projecting mechanism including the means holding the balls to be projected. Thus the oscillating means are, of necessity, large and cumbersome. Cumbersome and heavy ball flight control means are not desirable when trying to provide lightweight and portable ball projecting machines.

It is therefore an object of the present invention to provide a ball flight control device provided with an oscillating action which makes swing a ball projecting tube of the machine according to a predetermined angle about a vertical axis. This angle can be varied so that balls are projected from the tube within a narrow range or wide range up to, and even exceeding, the width of a tennis court.

It is another object of the present invention to provide a simple and lightweight ball flight control device for use with a ball projecting machine.

It is another object of the present invention to provide a ball flight control device which is relatively inexpensive to construct and reliable to use.

Therefore, according to the present invention there is provided a device for use with a ball projecting machine for controlling the flight of a ball projected from the machine through a flexible tube. The device has a first casing and means for pivotably mounting the first casing at one end to the machine for swinging movement about a generally upright axis. A second casing is provided adjacent the other end of the first casing. Means pivotably mount the second casing at its one adjacent end to the first casing for swinging movement about a generally horizontal axis. The first and second casings are adapted to carry the flexible tube, with the second casing having means at its other end for holding the outlet end of the flexible tube.

Preferably, the device includes means for oscillating the first casing, and thus the second casing also, about the upright axis, relative to the machine.

A preferred embodiment of the invention will now be described in detail having reference to the accompanying drawings in which:

FIG. 1 is a perspective view of the device attached to a tennis ball projecting machine;

FIG. 2 is a detail perspective view of the device;

Figure 3:
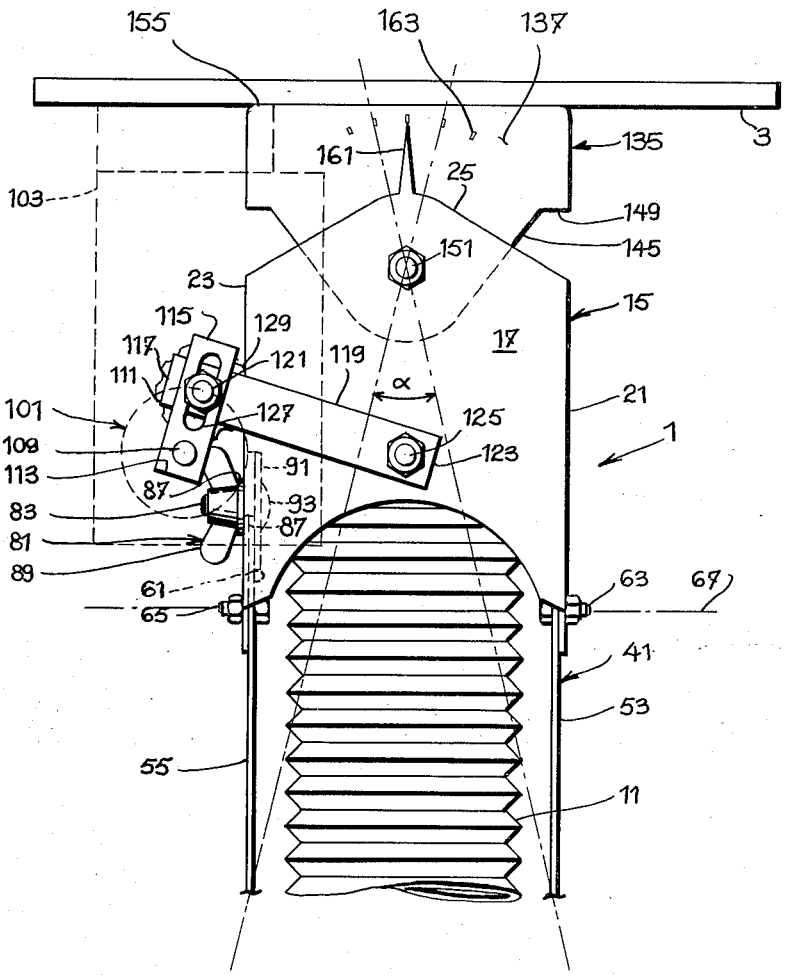
FIG. 3 is a partial plan view of the device.

The ball flight control device 1, as shown in the figures is adapted to be mounted on the front 3 of a tennis ball projecting machine 5. These machines 5 are constructed to project tennis balls 7, carried in a rack or tray 9 on top of the machine through a tube 11 onto a tennis court. The balls are usually projected pneumatically, one at a time, at selected intervals and velocity, as is well known. The tube 11 is flexible and can comprise a spiral wire covered with a suitable flexible cover as is well known.

The ball flight control device 1 is provided to control the flight of the ball from the tube 11. The device 1 has a first casing 15 comprising a four-walled tubular member having top and bottom walls 17, 19 and sidewalls 21, 23 made from suitable sheet material. Integral ears 25, 27 project rearwardly from the top and bottom walls 17, 19 respectively. The ears 25, 27 are used to attach the casing at its rear end to the machine 5 for swinging movement, relative to the machine, about a generally upright axis 31 as will be described.

The device 1 has a second casing 41 with its rear end adjacent the front end of first casing 15. The second casing 41 comprises a U-shaped, channel member having a pair of sidewalls 53, 55 and a bottom wall 57 made from suitable sheet material. The second casing 41 is relatively long compared to the length of first casing 15. The second casing 41 has a pair of ears 59, 61 projecting rearwardly from the sidewalls 53, 55, from its rear end to lie adjacent the bottom, front end of sidewalls 21, 23 respectively of the first casing. A pair of bolts 63, 65 pivotably connect second casing 41 to first casing 15. Bolt 63 connects ear 59 to sidewall 21 and bolt 65 connects ear 61 to sidewall 23. The bolts 63, 65 are aligned and form a generally horizontal pivot axis 67 about which second casing 41 can pivot relative to first casing 15.

A split tubular collar 69 is fixed to the free front end 71 of second casing 41. The flexible tube 11 sits in casing 41 and its non-corrugated outlet end 75 passes into collar 69. A tightening ring 73 on collar 69 tightly clamps split collar 69 about the outlet end 75 of tube 11 to hold it in place.

Figure 4:
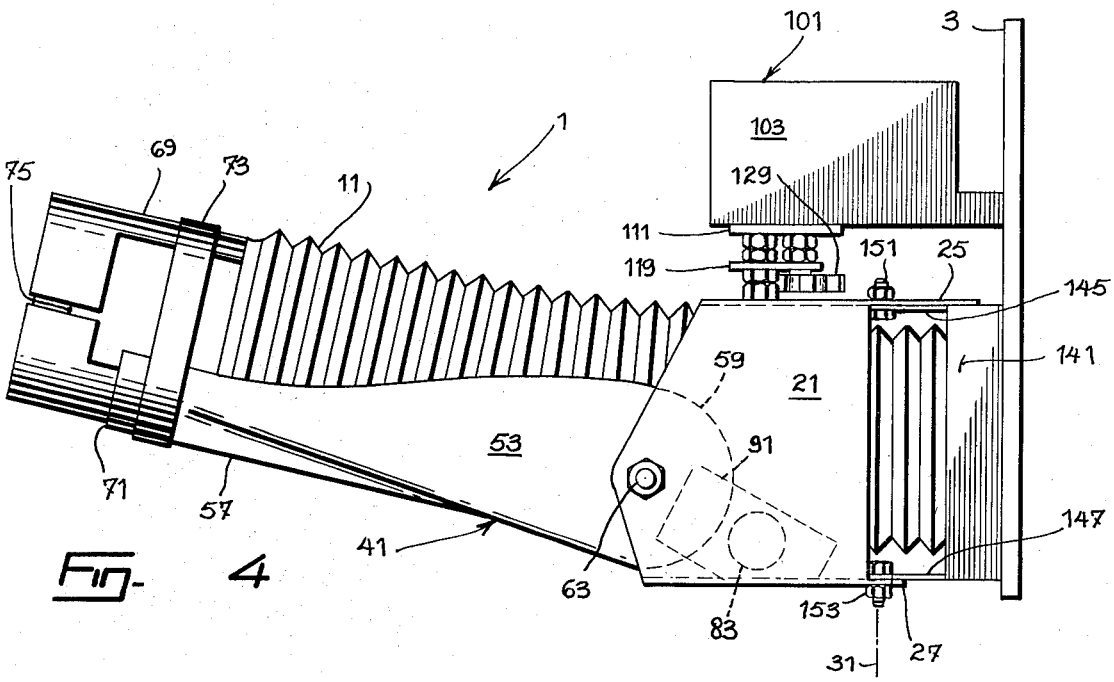
FIG. 4 is an elevation view of the device.

Casing 41 can be pivoted about axis 67 to raise or lower outlet end 75 of tube 11. Once the desired height is obtained, casing 41 is locked in place relative to first casing 15. Suitable locking means 81 are provided to accomplish this. The locking means 81 comprises a bolt 83 passing through sidewall 23 of first casing 15 adjacent ear 61 of second casing 41. A washer 85 is mounted on bolt 83, on one side of wall 23, and a wingnut 89 is threaded onto bolt 83 outside wall 23. A clamping bar 91 is mounted on bolt 83 between outside wall 23 and bolt head 93. Bar 91 is large enough to overlie a portion or ear 61 as shown in FIG. 4. When it is desired to adjust the height of tube end 75, nut 89 is loosened allowing casing 41 to pivot about axis 67 relative to casing 15. When the desired height is obtained nut 89 is tightened to clamp ear 61 between bar 91 and sidewall 23 to hold casing 41 in place.

Means 101 are provided for oscillating first casing 15, and thus second casing 41 also, about vertical axis 31. The oscillating means 101 has a power supply comprising motor-speed reducing unit 103 which is mounted on the front end 3 of the ball machine 5 by a bracket 105 and fasteners 107. An output shaft 109 extends down from the bottom of unit 103. A crank arm 111 is fixed adjacent one end 113 to the end of shaft 109. Crank arm 111 is loosely, pivotably connected adjacent its other end 115 to one end 117 of a connecting arm 119 by bolt 121. The connecting arm 119 is pivotably connected at its other end 123 by a bolt 125 to the top wall 17 of first casing 15. The bolt 125 is located in the center of top wall 17 adjacent its front edge. The crank arm 111 has a longitudinal extending slot 127 in which bolt 121, and thus connected end 117 of arm 119 can slide to thus vary the throw of the crank arm 111. A tightening nut 129 is connected to bolt 121 to lock it in place in slot 127 after the desired throw has been selected. Bolt 121, while tightened in slot 127, remains loosely connected to end 117 of connecting arm 119. When shaft 109 is rotated, the first casing 15 and thus the second casing oscillated about vertical axis 31, via arms 11, 119, to swing the tube according to a predetermined angle $\alpha$. The angle $\alpha$ varies with the position of the bolt 121 inside slot 127.

A third casing 135 is provided to connect casing 15 to machine 5. Third casing 135 comprises a four-walled tubular member having top and bottom walls 137, 139 and sidewalls 141, 143, made from suitable sheet material. Casing 135 is relatively short compared to the length of first casing 15. A pair of ears 145, 147 project forwardly from the front end 149 of casing 135 from walls 137, 139 respectively to lie adjacent the ears 25, 27 respectively projecting rearwardly from first casing 15. Bolts 151, 153 pivotably connect the adjacent ear pairs together, the bolts 151, 153 being aligned to provide the vertical pivot axis 31. The front end 155 of the third casing 135 is fixed to front end of the machine by suitable fastening means (not shown). The three successive casing members 135, 15 and 41 carry the tube 11 from the machine.

The device 1 provides a simple mechanism for use with a ball machine for guiding projected balls between high and low trajectories, depending on the height of the tube outlet end 75; and between the sidelines of a tennis court to a degree dependent of the crank throw.

If desired, a pointer 161 (FIG. 3) can be provided on first casing 15 projecting rearwardly from the center of top wall 17. The pointer 161 is aligned with the vertical axis 31 and the center of bolt 125 (FIG. 3). A scale 163 can be provided on the top surface of top wall 137 of third casing 135. The scale 163 provides an indication for setting the crank throw to cover a wide or narrow width of court.

The motor in the motor-reducer unit 103 can be an electric motor. Alternatively, the motor can be carried by the ball machine 5 and a connection can be made therefrom by a shaft to the reducer unit 103.

The device 1 can be pivotably connected via the ears 25, 27 on casing 15 directly to flanges provided on the front end 3 of machine 5.

I claim:

1. A device for use with a ball projecting machine for controlling the flight of a ball projected from the machine through a flexible tube, said device comprising a first casing; means for pivotably mounting the first casing at one end to the machine for swinging movement about a generally upright axis; a second casing adjacent the other end of the first casing; means for pivotably mounting the second casing at its one adjacent end to the first casing for swinging movement about a generally horizontal axis; said first and second casings being adapted to carry the flexible tube of the ball projecting machine, said second casing having means at its other end for holding the outlet end of said flexible tube; and means for oscillating the first casing, and thus the second casing also, about the upright axis.

2. A device as claimed in claim 1 wherein the oscillating means has means for varying the amount of oscillation.

3. A device as claimed in claim 2 wherein the oscillating means has a power supply means ajacent the first casing, a drive shaft extending from the power supply means, a crank arm fixed at one end to the shaft, a connecting arm pivotably connected between the other end of the crank arm and the first casing, a slot in the crank arm at its other end, and means for adjusting the pivot connection between the crank and connecting arms in the slot to thus fix said predetermined angle.

4. A device as claimed in claim 1 wherein the second casing is adjustable about the horizontal axis to raise or lower its other end, and means are provided to lock the second casing to the first casing with its other end at a desired height.

5. A device as claimed in claim 4 wherein the locking means comprise a clamping bolt mounted on the first casing, the bolt carrying clamping means to clamp a portion of the second casing against the first casing.

6. A device as claimed in claim 1 wherein the first casing comprises a four-walled, tubular member, the top and bottom walls of the casing at the one end, having projections by which the first casing is pivotably mounted to the machine; the second casing comprising a three-walled channel member, the sidewalls of the second casing having projections at its one end to lie adjacent the sidewalls of the first casing.

7. A device as claimed in claim 6 including a third casing adjacent the one end of the first casing, the third casing comprising a four-walled tubular member, the projections on the first casing being pivotably connected to the top and bottom walls of the third casing at one end, the other end of the third casing being fixed to the machine.

8. A device for use with a ball projecting machine for controlling the flight of a ball projected from the machine through a flexible tube; the device having a first casing; means for pivotably mounting the first casing at one end to the machine for swinging movement about a generally upright axis; a second casing adjacent the other end of the first casing; means for pivotably mounting the second casing at its one adjacent end to the first casing for swinging movement about a generally horizontal axis; the first and second casings adapted to carry the flexible tube, with the second casing having means at its other end for holding the outlet end of the flexible tube, means for oscillating the first casing, and thus the second casing according to a predeterminated angle about the upright axis, said oscillating means having a power supply means adjacent the first casing, a drive shaft extending from the power supply means, a crank arm fixed at one end to the shaft, a connecting arm pivotably connected between the other end of the crank arm and the first casing, a slot in the crank arm at its other end, and bolt and nut means for adjusting the pivot connection between the crank and connecting arms in the slot to thus fix said predetermined angle.

9. A device according to claim 8, wherein said means for holding the outlet end of the flexible tube comprises a split tubular collar fixed to said other end of said second casing, and a tightening ring on said collar to tightly clamp said collar about said other end of said flexible tube.

* * * * *